United States Patent [19]

Del Fresno

[11] Patent Number: 4,833,297

[45] Date of Patent: May 23, 1989

[54] IMPROVED ARRANGEMENT IN STEAM IRON PROTECTION CIRCUITS

[75] Inventor: Miguel L. Del Fresno, San Sabastian, Spain

[73] Assignee: Oficina de Investigacion Agrupada, S.A., Spain

[21] Appl. No.: 185,378

[22] Filed: Apr. 22, 1988

Related U.S. Application Data

[63] Continuation of Ser. No. 871,110, Jun. 5, 1986, abandoned.

[30] Foreign Application Priority Data

Jun. 7, 1985 [ES] Spain ..... 287.272

[51] Int. Cl.[4] ..... D06F 75/26

[52] U.S. Cl. ..... 219/250; 219/256; 38/82; 361/114

[58] Field of Search ..... 361/114, 115; 219/251–253, 256, 257, 481; 38/82

[56] References Cited

U.S. PATENT DOCUMENTS

| | | | |
|---|---|---|---|
| 3,165,623 | 1/1965 | Smith | 219/252 |
| 4,347,428 | 8/1982 | Conrad et al. | 219/251 |
| 4,536,641 | 8/1984 | Chan | 337/414 X |
| 4,686,352 | 8/1987 | Nawrot et al. | 219/251 X |

*Primary Examiner*—Todd E. Deboer

*Attorney, Agent, or Firm*—Lucas & Just

[57] ABSTRACT

A steam iron having a protection circuit which is located in a detachable back cover. The back cover can be detached from the iron to allow substitution of an inoperative protection circuit.

4 Claims, 2 Drawing Sheets

IMPROVED ARRANGEMENT IN STEAM IRON PROTECTION CIRCUITS

This is a continuation of application Ser. No. 871,110, filed June 5, 1986, now abandoned.

This invention relates to steam irons and more particularly to an improved arrangement in a steam iron protection circuit.

Different steam irons are today known which incorporate a heating protection circuit that automatically cuts off the supply current of the heating resistor, using for that purpose different elements, which are arranged in the iron separately, thus converting the standard steam iron into a more efficient object, since the heat of same is thereby controlled.

Because of the location of the protection elements, very close to the steam circuit, and since special placement zones have not been used, the present steam irons do not have a great enough overall efficiency, and that is due to the fact that problems of moisture in the protection elements arise, the source of which is in the steam circuit.

As far as possible damages to the protection circuit are concerned and taking into account the uneven placement of its elements, when any of them is damaged, that makes independent use of the iron impossible, but rather it is put out of use, since said circuit is inserted in the general supply circuit of the iron.

The possibility that a steam iron can operate alone, independent of the protection circuit, is not feasible with the arrangement of the protection elements of the present irons.

The model now recommended is a steam iron with an improved arrangement of the protection circuit, thereby obtaining a modern object, totally safe and with notable efficiency, at the same time as incorporating the possibility of use independent of the protection circuit; therefore, even in case of damage to the latter, the iron is not put out of use.

Accordingly, it is established that all of the elements included in the protection circuit are grouped and accommodated in the back cover of the iron, which is joined to the latter by means of screws, forming an independent part, and the location is far enough from the steam circuit so that there can be no moisture complications; in this way, the disadvantage of the present system is eliminated.

The protection circuit is connected in series to one of the feed wires of the iron; this enables the iron to be used without the protection circuit, in case of possible damage to same; it will be sufficient to open the back cover and to establish the coupling in series of the feeder bridged, for which it will be necessary to disconnect the protection in advance. It is thus possible to improve the efficiency of the steam iron with the present protection circuit and to correct the disadvantage of same.

As is evident from everything so far described, the model now recommended presents a series of characteristics that distinguish it fundamentally from everything hitherto known in this field, thereby giving it its own individuality.

To understand the nature of this invention better, on the attached drawing we present a schematic representation of its use, absolutely not being limitative and therefore lending itself to additional modifications that do not alter the essential characteristics.

CLARIFYING DETAILS

Figure 1:
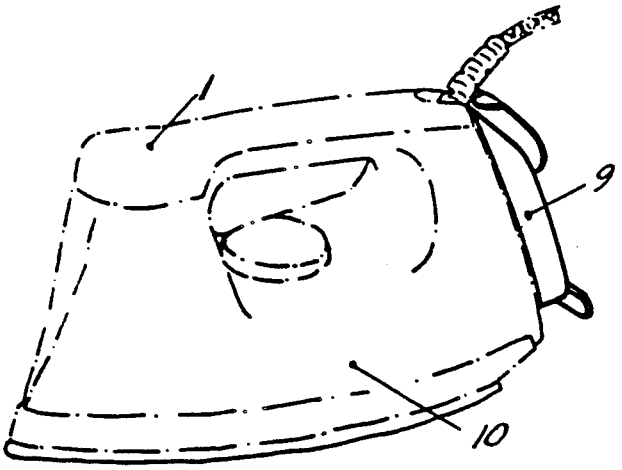
FIG. 1 represents the steam iron in perspective, with the location of the protection circuit incorporated.
Figure 6:
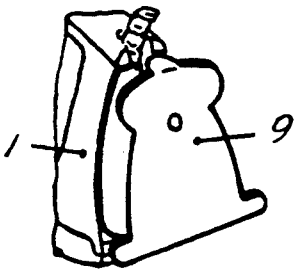
FIG. 6 represents in perspective the exact location of the back cover, which is joined to the iron by means of screws.
Figure 5:
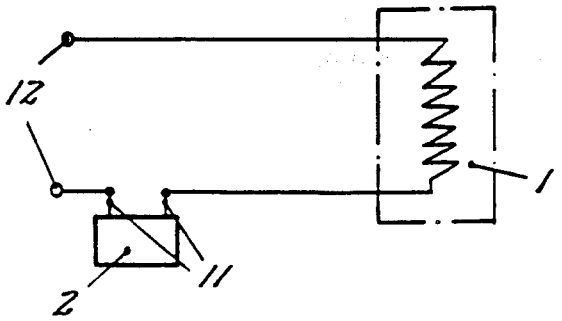
FIG. 5 represents the series connection of the protection circuit with one of the feed wires of the iron.

1. Iron
2. Protection circuit
3. Circuit breaker
4. Mercury switch
5. Timer
6. Integrated circuit
7. Feed resistor
8. Sound alarm
9. Back cover
10. Steam circuit
11. Circuit connecting cables
12. Feed wires of iron
13. Recess of cover
14. Plastic casing
15. Partition The model of this invention is a steam iron (1) of the type that incorporates a protection circuit (2), grouping all the elements and accommodating them in the back cover (9), which in turn is screwed to the iron (1).

The protection circuit (2) is connected by two cables (11) which are coupled in series to one of the feed wires of the iron (12) at a perfectly accessible location that makes it possible to connect and disconnect the protection circuit (2) with complete ease.

The protection circuit (2) of the steam iron incorporates the circuit breaker (3), which interrupts the passage of current, and the latter is controlled by protection elements that can include a mercury switch (4), a timer (5), an integrated circuit (6) with a feed resistor (7), a sound alarm (8), etc.

The feed resistor (7) fulfills a double role: on the one hand, it absorbs voltage and makes it possible to supply the integrated circuit (6) with adequate voltage; on the other, the heat it dissipates favors elimination of the moisture that might exist in the protection circuit (2).

The location of the back cover (9), where the protection circuit (2) is situated, is far enough from the steam circuit (10), and there is no possibility that the moisture released in the water vaporization process can damage in the slightest any of the components comprising the protection circuit (2).

Figure 3:
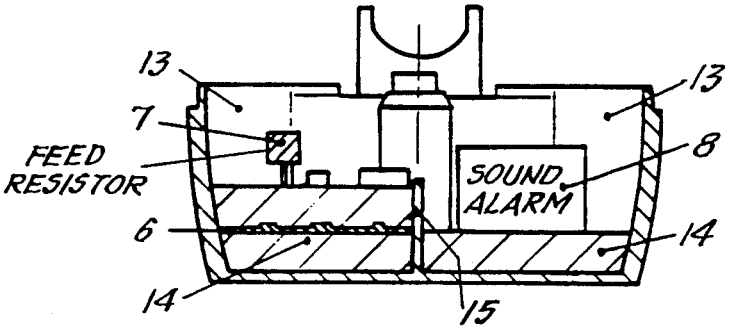
FIG. 3 represents a section of the back cover taken along line A—A of FIG. 2 in which is shown the plastic casing with different thicknesses, as well as the partition.
Figure 2:
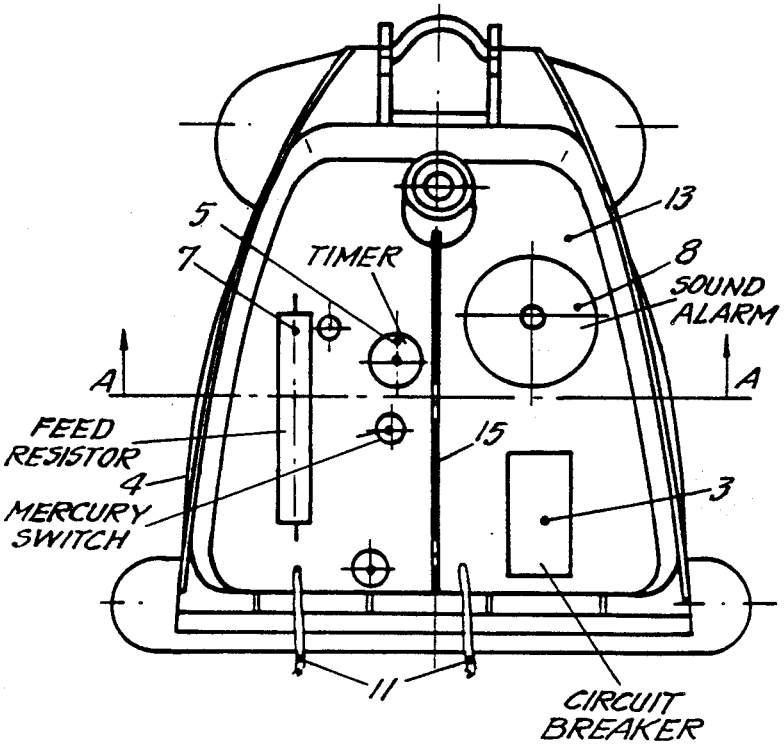
FIG. 2 represents an interior elevation of the back cover, showing the location of the different components comprising the protection circuit.
Figure 4:
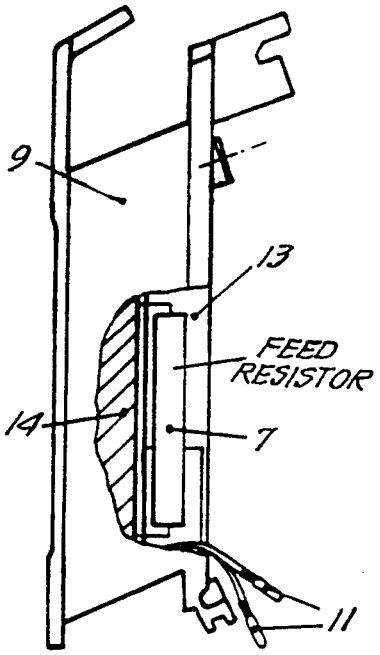
FIG. 4 represents a sectional view of the back cover, in which the possibility of winding up the feed cable is shown.

If the back cover (9) is equipped with protuberances that make it possible to wind up the feed cable in same, they have a recess (13) inside that will be used as a mold for making there the plastic casing (14) insulating the protection circuit (2). This interior recess of the cover (13) is divided by means of a partition (15) that is used to distribute the elements requiring different thickness of plastic in its casing, thereby achieving a notable saving of plastic; thus, FIG. 3 clearly shows how the thickness of casing in the elements on the left is appreciably greater than the thickness on the right.

The series connection to one of the feed wires (12) of the protection circuit (2) and ease of connection and disconnection make it possible, when the protection circuit (2) is damaged, to establish the series coupling of the feeders (12) easily, disconnecting the protection (2) in such a way that the iron (1) can continue operating, devoid, of course, of the protection circuit (2); in this way, it is possible to repair a damage in the circuit (2) without having to put the iron (1) out of use.

Special care has been taken to locate the feed resistor (7) of the integrated circuit (2) properly, for which purpose its body has been mounted separate from the plastic casing (14), so that its dissipated heat can be taken advantage of to eliminate the moisture that might exist in the space, since the moisture coming from the steam circuit (10) has been avoided by locating the protection circuit (2) far enough away to remain unaffected.

The improved arrangement of the protection circuit (2) in steam irons (1) makes rapid substitution possible by means of a simple disconnection of the circuit connecting cables (11) that are coupled in series to one of the feed wires of the iron (12).

The nature of this invention as well as its manufacture having been sufficiently described, it only remains to be added that it is possibe to introduce changes in form, material and arrangement in the unit as a whole and in its components, as long as such alterations do not involve any substantial variation of same.

I claim:

1. In a steam iron having a housing, said housing having a top, a bottom, a back, two sides, and a pointed front, a handle positioned on the top of said housing, a soleplate attached to the bottom of said housing, an electrical circuit for generating heat and steam, said electrical circuit positioned in said housing, and a cord for carrying electricity from an external power source to said electrical circuit, an improvement in said iron comprising: a back cover having a protection circuit affixed therein, said back cover detachably attached to the back of said housing and said protection circuit detachably connected by a single pair of leads to said electrical circuit in series such that if said protection circuit is inoperable, said back cover can be detached from said iron thereby allowing substitution of the inoperative protection circuit with an operative protection circuit and reconnection of the leads to make said steam iron operate, said protection circuit comprising a circuit breaker, an integrated circuit and a feed resistor, said feed resistor being mounted in said back cover a distance from the other elements in said protection circuit thereby allowing heat to dissipate from said feed resistor and driving off moisture from said protection circuit.

2. The improved steam iron of claim 1 wherein said back cover is made of plastic and said back cover is divided into sections by means of partitions and said protection circuit is divided into said sections.

3. The improved iron of claim 1 wherein the back cover further comprises protuberances upon which to wind said cord.

4. In a steam iron having a housing, said housing having a top, a bottom, a back, two sides, and a pointed front, a handle positioned on the top of said housing, a soleplate attached to the bottom of said housing, an electrical circuit for generating heat and steam positioned in said housing, and a cord for carrying electricity from an external power source to said electrical circuit, an improvement in said iron comprising: a back cover having a protection circuit affixed therein, said back cover detachably attached to the back of said housing and said protection circuit detachably connected by a single pair of leads to said electrical circuit in series such that if said protection circuit is inoperable, said back cover can be detached from said iron thereby allowing substitution of the inoperative protection circuit with an operative protection circuit and reconnection of the leads to make said steam iron operate; and said protection circuit comprising a circuit breaker, a mercury switch, a timer, an integrated circuit, a sound alarm, a feed resistor, said feed resistor being mounted in said back cover a distance from the other elements in said protection circuit thereby allowing heat to dissipate from said feed resistor and driving off moisture from said protection circuit.

* * * * *